US010334875B2

(12) United States Patent
Sampson et al.

(10) Patent No.: US 10,334,875 B2
(45) **Date of Patent: *Jul. 2, 2019**

(54) FILTER

(71) Applicant: British American Tobacco (Investments) Limited, London (GB)

(72) Inventors: John Roger Sampson, London (GB); David Lewis, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/738,357

(22) Filed: Jun. 12, 2015

(65) Prior Publication Data

US 2015/0272209 A1 Oct. 1, 2015

Related U.S. Application Data

(63) Continuation of application No. 13/906,125, filed on May 30, 2013, now Pat. No. 9,078,471, which is a (Continued)

(30) Foreign Application Priority Data

Jul. 17, 2007 (GB) ..... 0713905.8

(51) Int. Cl.
*A24D 3/10* (2006.01)
*A24D 3/02* (2006.01)
(Continued)

(52) U.S. Cl.
CPC ..... *A24D 3/10* (2013.01); *A24D 3/0212* (2013.01); *A24D 3/048* (2013.01); *A24D 3/063* (2013.01)

(58) Field of Classification Search
CPC ..... A24D 3/0212; A24D 3/048; A24D 3/063; A24D 3/10
See application file for complete search history.

(56) References Cited

U.S. PATENT DOCUMENTS 3,552,400 A 1/1971 Berger et al.
4,088,065 A 5/1978 Hall
(Continued)

FOREIGN PATENT DOCUMENTS

AT 400997 B 5/1996
CH 635232 A2 3/1983
(Continued)

OTHER PUBLICATIONS

Office Action, dated May 23, 2013 for Taiwanese Patent Application 097126863, filed Jul. 16, 2008. [Cited and submitted in U.S. Appl. Nos. 12/669,463 & 13/906,125].
(Continued)

*Primary Examiner* — Michael H. Wilson
*Assistant Examiner* — Dionne W. Mayes
(74) *Attorney, Agent, or Firm* — Cantor Colburn LLP

(57) ABSTRACT

A filter for a cigarette comprises a porous fitter rod and a material sheet wrapped around the filter rod and a cellulose acetate thread formed from substantially uncrimped cellulose acetate filaments. The cellulose acetate thread is positioned within the filter rod and extends along the central axis of the filter rod.

20 Claims, 2 Drawing Sheets

Related U.S. Application Data continuation of application No. 12/669,463, filed as application No. PCT/EP2008/058332 on Jun. 27, 2008, now Pat. No. 8,550,092.

(51) Int. Cl.
*A24D 3/04* (2006.01)
*A24D 3/06* (2006.01)

(56) References Cited

U.S. PATENT DOCUMENTS

| | | | | |
|---|---|---|---|---|
| 4,281,671 | A | 8/1981 | Bynre et al. | |
| 4,393,885 | A | 7/1983 | Silberstein | |
| 4,601,298 | A | 7/1986 | Nichols et al. | |
| 4,768,526 | A | 9/1988 | Pryor | |
| 5,012,828 | A * | 5/1991 | Hayes et al. | A24D 3/0212 131/341 |
| 5,012,829 | A | 5/1991 | Thesing et al. | |
| 5,415,189 | A | 5/1995 | Sampson et al. | |
| 5,826,592 | A | 10/1998 | Brackmann | |
| 5,913,311 | A | 6/1999 | Ito et al. | |
| 5,979,460 | A | 11/1999 | Matsumura | |
| 6,089,238 | A | 7/2000 | Schneider et al. | |
| 7,740,019 | B2 | 6/2010 | Nelson et al. | |
| 2003/0140932 | A1 | 7/2003 | Seidel et al. | |
| 2003/0224918 | A1 | 12/2003 | Lanier, Jr. et al. | |
| 2004/0187881 | A1 | 9/2004 | Jupe et al. | |
| 2005/0000532 | A1 | 1/2005 | Bereman | |

FOREIGN PATENT DOCUMENTS

| | | | |
|---|---|---|---|
| CH | 635232 | A5 | 3/1983 |
| CL | 36098 | | 1/1987 |
| CN | 1042054 | A | 5/1990 |
| CN | 1176077 | A | 3/1998 |
| DE | 2916062 | A1 | 10/1979 |
| DE | 3246898 | A1 | 7/1983 |
| DE | 4322967 | C1 | 10/1994 |
| EA | 004483 | B1 | 4/2004 |
| EP | 0117138 | A2 | 8/1984 |
| EP | 0128031 | A2 | 12/1984 |
| EP | 0196867 | A2 | 10/1986 |
| EP | 0321740 | A1 | 6/1989 |
| EP | 0392112 | A1 | 10/1990 |
| EP | 0474940 | A1 | 3/1992 |
| EP | 0628260 | A2 | 12/1994 |
| EP | 0790007 | A1 | 8/1997 |
| EP | 0875160 | A1 | 11/1998 |
| EP | 0704172 | B1 | 11/2001 |
| EP | 1341424 | A1 | 9/2003 |
| EP | 1474008 | A1 | 11/2004 |
| EP | 1341424 | B1 | 8/2007 |
| EP | 1972213 | A1 | 9/2008 |
| FR | 1353720 | A | 2/1964 |
| FR | 2518374 | A1 | 6/1983 |
| GB | 1435711 | A | 5/1976 |
| GB | 2020158 | A | 11/1979 |
| GB | 2020536 | A | 11/1979 |
| GB | 2113066 | A | 8/1983 |
| GB | 2223393 | A | 4/1990 |
| JP | 5446900 | B2 | 4/1979 |
| JP | 6098978 | A | 6/1985 |
| JP | 60146027 | A | 8/1985 |
| JP | 2701974 | B2 | 10/1997 |
| JP | 2955558 | | 10/1999 |
| JP | 2003174862 | A | 6/2003 |
| JP | 2004535158 | A | 11/2004 |
| JP | 3902059 | B2 | 1/2007 |
| KR | 10-0137045 | B1 | 2/1998 |
| RU | 2106790 | C1 | 3/1998 |
| RU | 2130279 | C1 | 5/1999 |
| WO | 8500092 | A1 | 1/1985 |
| WO | 9009741 | A1 | 9/1990 |
| WO | 9507633 | A1 | 3/1995 |
| WO | 9605743 | A1 | 2/1996 |
| WO | 0072705 | A1 | 12/2000 |
| WO | 0245531 | A1 | 6/2002 |
| WO | 02069745 | A1 | 9/2002 |
| WO | 03059095 | A1 | 7/2003 |
| WO | 03059096 | A1 | 7/2003 |
| WO | 03082558 | A1 | 10/2003 |
| WO | 2006014994 | A1 | 2/2006 |
| WO | 2006020098 | A2 | 2/2006 |
| WO | 2007085830 | A2 | 8/2007 |
| WO | 2007121439 | A2 | 10/2007 |
| WO | 2009010380 | A2 | 1/2009 |

OTHER PUBLICATIONS

Rustermeyer, P., "CA Filter Tow for Cigarette Filters," Macromol. Symp. 2004, 208, pp. 267-291. [Cited and submitted in U.S. Appl. Nos. 12/669,463 & 13/906,125].

Eastman Chemical Company's "Estron" and "Chromspun" product websites, http://www.eastman.com/Brands/Eastman_Estron/Pages/Overview.aspex and http://www.eastman.com/Brands/Eastman_Chromspun/Pages/Overview.aspx, both accessed Jan. 10, 2012. [Cited and submitted in U.S. Appl. Nos. 12/669,463 & 13/906,125].

Product Brochures for Eastman Chemical Company's "Estron Acetate Yarn" and "Chromspun Acetate Yarn" products, dated Sep. 2006. [Cited and submitted in U.S. Appl. Nos. 12/669,463 & 13/906,125].

"Fibres, Cellulose Esters," Kirk-Othmer Encyclopedia of Chemical Technology, John Wiley & Sons Inc., Dec. 2000 [Cited and submitted in U.S. Appl. Nos. 12/669,463 & 13/906,125].

Jaouardi, M., "Evaluation of Real Yarn Diameter," The Indian Textile Journal, Sep. 2007. [Cited and submitted in U.S. Appl. Nos. 12/669,463 & 13/906,125].

Filtrona Catalogue—Bates No. 510256274/6315 (1986). [Cited and submitted in U.S. Appl. Nos. 12/669,463 & 13/906,125].

International Search Report and Written Opinion, dated Feb. 4, 2009, corresponding to PCT/EP2008/058332, filed Jun. 27, 2008. [Cited and submitted in U.S. Appl. Nos. 12/669,463 & 13/906,125].

International Preliminary Report on Patentability, dated Sep. 22, 2009, corresponding to PCT/EP2008/058332, filed Jun. 27, 2008. [Cited and submitted in U.S. Appl. Nos. 12/669,463 & 13/906,125].

British American Tobacco (Investments) Limited, Summons to attend oral proceedings pursuant to Rule 115(1) EPC, dated Nov. 21, 2014 for EP 2166887B1.

Philip Morris Products S.A. Written Submission in preparation for Oral Proceedings for EP 2166887B1, filed Mar. 27, 2015. [Cited and submitted in U.S. Appl. No. 13/906,125].

JT International S.A. Written Submission in preparation for Oral Proceedings for EP 2166877B1, filed Mar. 27, 2015. [Cited and submitted in U.S. Appl. No. 13/906,125].

Decision by the European Patent Office Technical Board of Appeal 3.3.2, dated Jul. 26, 1988 (Case No. T256/87), (designated as D46). [Cited and submitted in U.S. Appl. No. 13/906,125].

Decision by the European Patent Office Technical Board of Appeal 3.3.3., dated May 13, 1997 (Case No. T225/93), (designated as D47). [Cited and submitted in U.S. Appl. No. 13/906,125].

Decision by the European Patent Office Technical Board of Appeal 3.3.2., dated Aug. 10, 2004 (Case No. T83-01), (designated as D48). [Cited and submitted in U.S. Appl. No. 13/906,125].

Decision by the European Patent Office Technical Board of Appeal 3.2.04., dated Jun. 24, 2008 (Case No. T63/06), (designated as D49). [Cited and submitted in U.S. Appl. No. 13/906,125].

Photographs of KENT HDI Package (designated as D50a), 2 pages. [Cited and submitted in U.S. Appl. No. 13/906,125].

Photographs of KENT HDI Cigarette (designated as D51a), 5 pages. [Cited and submitted in U.S. Appl. No. 13/906,125].

"Bulk Density", taken from Wikipedia, the free encyclopedia, http://en.wikipedia.org./wiki/Bulk_density, Mar. 27, 2015, pp. 1-3 (designated as D52). [Cited and submitted in U.S. Appl. No. 13/906,125].

Fachwissen Bekleidung, 3rd Edition, 1993, cover pages and pp. 56-57, (designated as D53). [Cited and submitted in U.S. Appl. No. 13/906,125].

(56) References Cited

OTHER PUBLICATIONS

Fachwissen Bekleidung, 10th Edition, 2013, cover pages and pp. 72-73, (designated as D54). [Cited and submitted in U.S. Appl. No. 13/906,125].
Skyscan 1072 X-Ray Microscope—Microtomograph, Instruction Manual. 2001. [Cited and submitted in U.S. Appl. Nos. 12/669,463 & 13/906,125].
Rayon, from Wikipedia, URL: http://en.wikipedia.org/wiki/Rayon, pp. 1-9.
Sanjoy Debnath, "Effect of Linear density, twist and blend proportion on some physical properties of jute and hollow polyester yarn" Indian Journal of Fiber and Textile Research, vol. 34, Mar. 2009, pp. 11-19.
UK Search Report dated Apr. 18, 2007; pp. 1-6; citing: EP0196867A, EP0117138A, GB1435711A, JP2003174862A, JP60146027A and JP60098978A.

* cited by examiner

FILTER

This application is a continuation of U.S. patent application Ser. No. 13/906,125, filed May 30, 2013, which is a continuation of U.S. patent application Ser. No. 12/669,463, filed Jun. 21, 2010, which is the National Stage of International Application No. PCT/EP2008/058332, titled "Filter," filed Jun. 27, 2008, which in turn claims priority to United Kingdom Patent Application Number 0713905.8, filed Jul. 17, 2007. The entire contents of the aforementioned applications are herein expressly incorporated by reference.

FIELD OF THE INVENTION

The present invention relates to filters for cigarettes and other smoking articles.

BACKGROUND

A cigarette typically includes a tobacco rod and a filter connected to the tobacco rod. The filter is commonly made of cellulose acetate tow. A smoker ignites one end of the tobacco rod and draws smoke in through the filter. The filter traps some of the smoke products produced by the burning tobacco rod. In some cases, the filter can be arranged to impart additional characteristics to the cigarette such as flavour.

US patent application US-A-2003/0224918 describes a device for applying a flavourant bearing element along the central axis of a cigarette filter during the filter manufacturing process. The preferred flavoured element is cotton yarn, but other suggested materials for the flavoured element are cellulose acetate, rayon, or some other textile or non-textile materials capable of absorbing a liquid flavourant. UK patent application GB-B-2020158 describes a similar filter to that disclosed in US-A-2003/0224918. A thread or tape, for example cotton sewing thread or rayon, extends along a filter rod. A flavourant is incorporated into the filter rod.

Although a cotton thread absorbs flavour during manufacturing and then imparts flavour during smoking, it does have certain drawbacks as a flavourant. For example, the cotton thread may become discoloured as a result of smoke passing through the filter. One option to avoid such discolouration is to apply a dye to the cotton thread (where the colour of the dye would mask any discolouration). However, standard vat dyes for cotton are primarily intended for use with clothing; they generally do not have regulatory approval for food products (or for cigarettes, which are inserted into the mouth). In addition, the dye applied to cotton material may not be entirely colour-fast, and may therefore leach into the surrounding filter material. This is especially a problem if the cotton thread is exposed to a substance which may act as a solvent.

SUMMARY OF THE INVENTION

One embodiment of the invention provides a filter for a cigarette or other smoking article. The filter comprises a porous filter rod having a substantially cylindrical shape, and a cellulose acetate thread formed from substantially uncrimped cellulose acetate filaments. The cellulose acetate thread extends along the filter substantially parallel to the central cylindrical axis of the filter rod.

The use of cellulose acetate filaments for the central thread has been found to unexpectedly reduce or eliminate staining of the filter by smoke (compared to the use of a central thread made of cotton, for example). Having the filter made of uncrimped filaments is believed to assist with this, since it allows a tighter and more compact thread to be produced. Consequently, it is more difficult for the smoke to penetrate and stain the thread.

In general, the cellulose acetate thread extends along substantially the whole length of the filter rod. However, in other embodiments, the cellulose acetate thread may only extend partway along the length of the filter rod (especially for example if a multi-segmented filter is being used).

In one embodiment, the porous filter rod comprises cellulose acetate tow (although any other suitable filter material, e.g. paper, could be used instead). The cellulose acetate tow comprises a disordered overlapping arrangement of cellulose acetate filaments. In contrast, the cellulose acetate thread comprises an ordered arrangement of cellulose acetate filaments arranged substantially parallel to the central cylindrical axis of the filter rod. The cellulose acetate thread is therefore structurally distinct from the cellulose acetate tow, and the filaments of the cellulose acetate thread do not generally intermingle with those of the cellulose acetate tow.

The porous filter rod generally has a bulk density in the range 50-150 kg/m$^3$, while the cellulose acetate thread has a bulk density in the range 400-800 kg/m$^3$. The higher bulk density of the cellulose acetate thread can help to prevent staining and discolouration. In one particular embodiment, the cellulose acetate filaments in the thread are twisted about an axis aligned with the central cylindrical axis of the filter rod. The thread has a twist rate in the range 100-200 turns per meter.

The cellulose acetate thread generally incorporates a flavourant, such as menthol, or any other desired additive. In one particular embodiment, the filter comprises multiple cellulose acetate threads extending substantially parallel with the central cylindrical axis of the filter rod. These different threads may be separate from one another or twisted together into a single fibre. The different threads can be used to incorporate different flavourants.

In one embodiment, the cellulose acetate thread includes a pigment to impart colour to the thread. The pigment is incorporated directly into the material of the thread filaments at manufacture. This avoids the danger of colour leaching (in contrast to the situation with a cotton thread, where a dye can only be applied to the surface of the cotton, and is therefore susceptible to leaching).

In some embodiments, the cellulose acetate thread has a different colour from the porous filter rod. This colour contrast makes it easier for a machine control system to ensure that the thread is correctly placed within the filter rod, and may also be used for aesthetic and/or branding purposes. One possibility is that the particular pigment or colour used for a given thread may be used to indicate the flavour incorporated into the thread. For example, a green thread might be used to indicate a menthol flavourant.

In one embodiment, the cellulose acetate thread incorporates a plasticiser such as triacetin. The plasticiser can help the cellulose acetate filaments of the main filter rod to bond with the cellulose acetate filaments of the cellulose acetate thread (exploiting the fact that both the main filter rod and the cellulose acetate thread are formed from a synthetic material). This helps to retain the cellulose acetate thread in the correct position in relation to the filter rod.

In one embodiment, the cellulose acetate thread extends along the central cylindrical axis of the filter rod. This arrangement helps to provide a uniform distribution/dispersion of any flavourant incorporated into the filter. In another embodiment, there are multiple cellulose acetate threads extending along the filter substantially parallel to the central cylindrical axis of the filter rod. These multiple cellulose acetate threads may be arranged in a symmetric pattern about the central cylindrical axis of the filter rod, again to provide a substantially uniform dispersion of flavourant through the filter. Note that providing multiple threads in the filter can be used to increase total loading of flavourant within the filter, or to reduce the loading of flavourant per filter (which may assist with manufacturing, product storage, etc).

Another embodiment of the invention provides a filter for a cigarette or other smoking article. The filter comprises a porous filter rod having a substantially cylindrical shape, and a cellulose acetate thread formed from cellulose acetate filaments that include a pigment. The cellulose acetate thread extends along the filter substantially parallel to the cylindrical axis of the filter rod. The pigment can be used to impart a colour to the cellulose acetate thread, for example to assist with checking the positioning of the thread within the filter during manufacture.

This embodiment may benefit from the same features as described above in relation to the previous embodiments.

Another embodiment of the invention provides a filter for a cigarette or other smoking article. The filter comprises a porous filter rod having a substantially cylindrical shape, and a cellulose acetate thread formed from cellulose acetate filaments. The cellulose acetate thread incorporates a plasticiser and extends along the filter substantially parallel to the central cylindrical axis of the filter rod.

This embodiment may benefit from the same features as described above in relation to the previous embodiments.

Another embodiment of the invention provides a filter for a cigarette or other smoking article. The filter comprises a porous filter rod formed from cellulose acetate filaments and having a substantially cylindrical shape. The filter further comprises a cellulose acetate thread formed from cellulose acetate filaments that extend along the filter substantially parallel to the central cylindrical axis of the filter rod. The porous filter rod has a bulk density in the range 50-150 $kg/m^3$, while the cellulose acetate thread has a bulk density in the range 400-800 $kg/m^3$. The higher bulk density of the cellulose acetate thread can help to prevent staining and discolouration.

This embodiment may benefit from the same features as described above in relation to the previous embodiments.

Another embodiment of the invention provides a method of making a filter for a cigarette or other smoking article. The method comprises forming a cellulose acetate thread from substantially uncrimped cellulose acetate filaments. The method further comprises inserting the cellulose acetate thread into a porous filter rod having a substantially cylindrical shape, such that the cellulose acetate thread extends along the filter substantially parallel to the central cylindrical axis of the filter rod.

Another embodiment of the invention provides a method of making a filter for a cigarette or other smoking article. The method comprises forming a cellulose acetate thread from cellulose acetate filaments together with a pigment. The method further comprises inserting the cellulose acetate thread into a porous filter rod having a substantially cylindrical shape, such that the cellulose acetate thread extends along the filter substantially parallel to the central cylindrical axis of the filter rod.

Another embodiment of the invention provides a method for making a filter for a cigarette or other smoking article. The method comprises applying plasticiser to a cellulose acetate thread formed from cellulose acetate filaments. The method further comprises inserting the cellulose acetate thread into a porous filter rod having a substantially cylindrical shape, such that the cellulose acetate thread extends along the filter substantially parallel to the central cylindrical axis of the filter rod. The plasticiser may migrate from the thread to the porous filter rod, thereby helping to bind the two together.

These method embodiments may benefit from the same features as described above in relation to the other embodiments.

BRIEF DESCRIPTION OF THE DRAWINGS

Embodiments of the present invention will now be described by way of example only with reference to the accompanying drawings where like parts are provided with corresponding reference numerals and in which.

DETAILED DESCRIPTION

Figure 1:
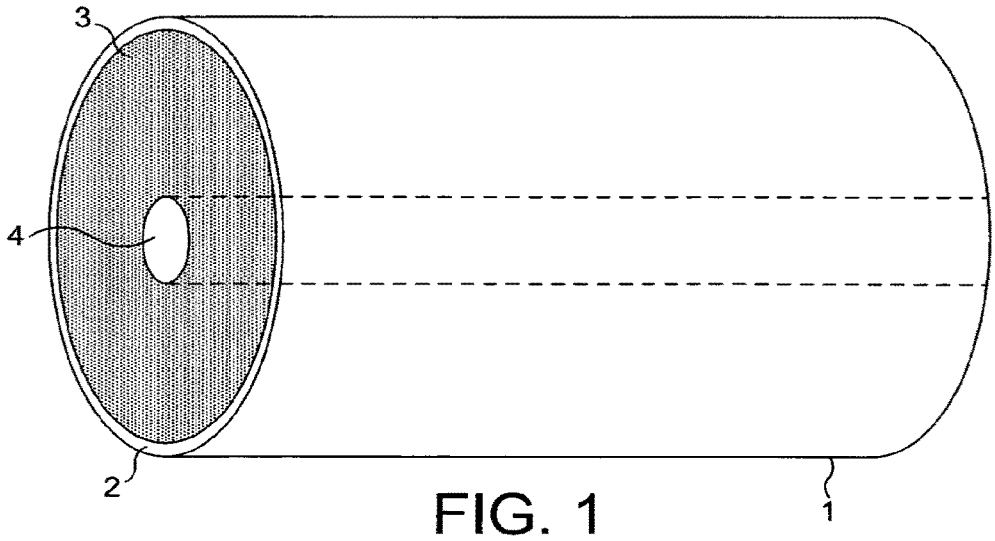
FIG. 1 provides a schematic diagram of a filter according to one embodiment of the present invention.

FIG. 1 shows a cigarette filter 1 in accordance with one embodiment of the present invention. The cigarette filter 1 comprises a wrapper layer 2 which may comprise a single layer or a plurality of layers, a main filter rod 3 formed of cellulose acetate tow, and a cellulose acetate (CA) thread 4 located along the central axis of the filter rod. Note that the use of cellulose acetate (rather than cotton) for thread 4 assists with regulatory approval for filter 1, since cellulose acetate is already widely used in filters (as cellulose acetate tow), whereas cotton is not commonly used in such filters.

Figure 2:
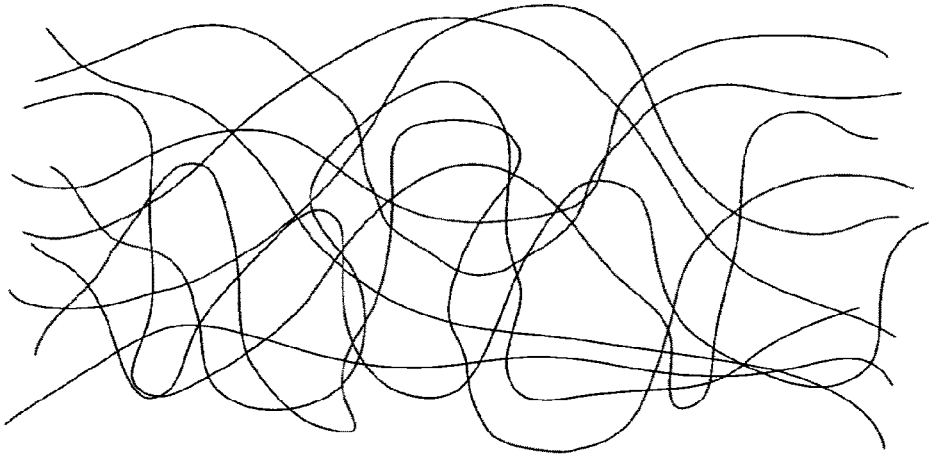
FIG. 2 is a schematic diagram of the arrangement of filaments in the main filter rod of FIG. 1 in accordance with one embodiment of the present invention.

The filter rod 3 is formed from cellulose acetate filaments that are crimped, stretched and then assembled to form a porous matrix having a chaotic, amorphous structure (see FIG. 2). This disordered structure provides a porous material, where the multiple filaments provide a large (internal) surface area to enhance the retention of smoke particles as smoke passes through the filter.

The crimp ratio (CR) of a fibre is a measure of the amount of crimping in a fibre and is defined as the ratio of the length (L1) of the uncrimped fibre to the length (L2) of the crimped fibre (the former being measured by extending the fibre under load). The higher the crimp ratio, the greater the amount of crimping, and hence the greater the reduction in length of the crimped fibre from its original (uncrimped) length. The crimp ratio can also be expressed as a percentage, known as the crimp index (CI), defined as 100*((L1−L2)/L2) (so that CI=100*(CR−1)).

The cellulose acetate filaments used in filter rod 3 are generally initially prepared with a high crimp ratio of perhaps 3-4. These filaments are then stretched during the filter manufacture, so that the crimp ratio of the filaments in the cellulose acetate tow within the filter itself is typically 1.25-1.4. The crimping helps to bulk out the tow material, as well as giving it the desired disordered structure shown in FIG. 2.

The cellulose acetate filaments used in filter rod 3 generally have a denier of approximately 1-8, with 2-3 being most common (1 denier represents a mass of 1 g/9000 m). The total denier of the filter rod 3 is given by the denier of the individual filaments multiplied by the number of filaments included within the rod, and is generally within the range 15,000-50,000 for cigarette filters; most commonly about 32,000. This corresponds to a typical density of about 50-150 kg/m$^3$ for a standard sized filter for a cigarette.

As shown in FIG. 1, the filter rod 3 includes centrally located CA thread 4, which may be used to impart additional characteristics such as flavour to the cigarette. In particular, the CA thread 4 may be used to incorporate a flavourant or other additive for the filter 1 (and cigarette). The flavourant is generally carried in a solvent such as propylene glycol or triacetin. The central location of CA thread 4 within the filter rod 3 helps to produce a uniform dispersal of the flavourant. However, in other embodiments, the CA thread 4 may have an off-centre location with the filter rod 3.

The CA thread 4 is formed from substantially continuous cellulose acetate filaments, as for the cellulose acetate tow, but the processing is different. The filaments forming the CA thread do not undergo crimping. In addition, the filaments of the CA thread are wound or twisted in a regular pattern to produce an ordered structure (see FIG. 3). In one embodiment, the rate of twisting of the filaments within the CA thread is approximately 100-200 turns per meter. (Note that although FIG. 3 illustrates one particular twisting pattern, other types of twisting pattern could also be used for the CA thread 4).

Figure 3:
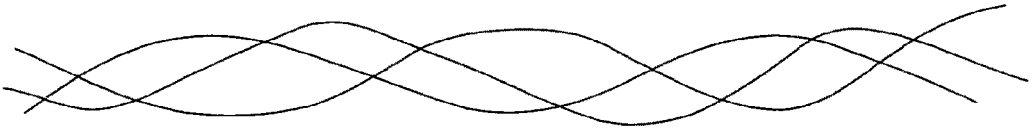
FIG. 3 is a schematic diagram of the arrangement of filaments in the central thread of FIG. 1 in accordance with one embodiment of the present invention.

A comparison of the tow material of FIG. 2 with the CA thread 4 of FIG. 3 shows that the paths of the cellulose acetate filaments within the main filter body are random and chaotic (and untwisted), such that there is no real directionality along the length of the filter. In other words, within a small portion of the tow material, the direction of the filaments is essentially random with respect to the main axis of the filter. In contrast, the paths of the cellulose acetate filaments within the thread are aligned and ordered, generally in a twisted or helical configuration, with clear directionality along the length of the filter (i.e. the axis of the helix is aligned with the main axis of the filter).

The filaments in the CA thread 4 may have a higher denier value compared with the material of the main filter rod. For example, in one embodiment, the filaments in CA thread 4 have a denier value of approximately 4, while in another embodiment the filaments in CA thread 4 have a denier value of approximately 7. A higher denier results in a thicker filament.

The total denier of the thread 4 is generally in the range 1000-5000, for example, 3000. Bearing in mind the relatively small size of the CA thread 4 compared to the filter rod 3, this implies a higher density for the CA thread of approximately 400-800 kg/m$^3$. This higher density is in part due to the higher denier per filament, and also due to the tighter packing of the uncrimped, ordered filaments within the CA thread 4 (compared to the looser and disordered packing of the crimped filaments within the tow material). The higher density of the CA thread 4 compared to the tow material of the main filter body 3 may assist the CA thread 4 in resisting staining by smoke.

Figure 4:
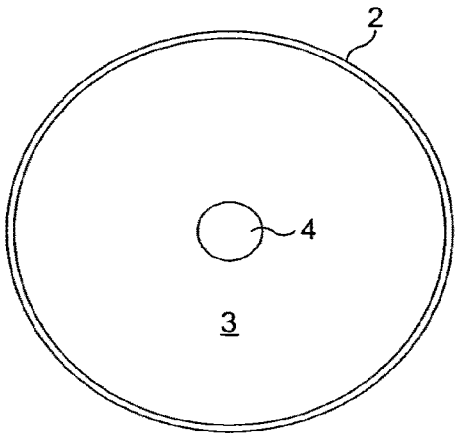
FIG. 4 is a cross-section through the filter of FIG. 1 according to one embodiment of the present invention.

Note that after assembly of the filter 1, the thread 4 and the main filter body 3 remain structurally distinct from one another within the filter 1. Thus FIG. 4 depicts a cross-section through filter 1, showing the central thread 4 surrounded by an annulus of the main filter rod 3, which is in turn surrounded by the plug wrap 2. Filaments of cellulose acetate within the central thread 4 generally remain within this central thread along the length of the filter; they do not transgress into the main filter rod 3. Likewise, cellulose acetate filaments within the main filter rod 3 generally remain within this main filter rod and do not transgress into the central CA thread 4. Note that this is despite the fact that the path of a given cellulose acetate filament in the main filter rod may wander over a substantial portion of the annulus of the main filter rod.

Thus it can be imagined that there is a boundary between the central thread 4 and the main filter rod 3. The cellulose acetate filaments in the central thread 4 and the main filter rod 3 generally do not cross this boundary, although they may contact one another at the boundary.

In the embodiment of FIG. 1, the thread 4 extends the whole length of the filter 1, in other words from the mouth end to the tobacco rod end. Accordingly, the thread 4 is generally visible to a consumer at the mouth end. Note that having the CA thread 4 extend the length of the filter assists in manufacturing, since it allows the filters to be readily produced as one long rod in a continuous process. In particular, the cellulose acetate tow and the CA thread can be supplied without interruption to form the continuous rod, which can then be segmented into filters for individual cigarettes as required.

It has been found that the CA thread 4 in filter 1 does not generally suffer from discolouration when a cigarette is smoked. This unexpected result is believed to be due to the increased density and ordered structure of the CA thread, which may prevent the smoke particles from penetrating (and hence staining) the CA thread 4. It will be appreciated that the absence (or reduced level) of discoloration is visible to a consumer, and may be perceived as a mark of improved quality (where the CA thread 4 extends to the mouth end of the filter 1, as shown in FIG. 1).

In one embodiment, the CA thread 4 is coloured. As cellulose acetate is formed using a synthetic process (albeit from natural products), one or more pigments can be incorporated into the cellulose acetate filaments as they are produced. Such pigments in effect become part of the substrate of the material, in contrast to dyes, which are applied to the surface of a material. Consequently, the pigments incorporated into the CA thread 4 cannot leach (they are colour-fast), unlike those applied to a cotton yarn.

Some of the pigments that may be used to colour the CA thread are already approved for use in food products (such as tartrazine yellow or E102). This makes it much easier from a regulatory perspective to use such pigments in cigarette filters. In addition, having a wider range of available pigments provides a greater choice (and control) of the colour applied to the CA thread 4.

In most filters, the cellulose acetate tow of the main filter rod 3 incorporates a white pigment (e.g. titanium dioxide). The CA thread 4 may also be coloured white to match the rest of the filter rod, or alternatively the CA thread 4 may have a different colour from the main filter rod. There are potential benefits in having contrasting colour for the CA thread 4 compared to the main filter rod. For example, different colours for the CA thread 4 may be used to indicate different flavourants in the cigarette, e.g. green for menthol, etc.

In addition, the ready visibility of the CA thread 4 serves as a deterrent to potential counterfeiters. Thus any counterfeit cigarettes must also include the central thread (otherwise they would be readily detected by consumers). However, this raises the manufacturing complexity and costs for the potential counterfeiters compared to making a filter just out of conventional cellulose acetate tow.

Furthermore, in a current implementation, the difference in colour between the filter rod 3 and the CA thread 4 allows a machine vision system to confirm automatically that the CA thread 4 is present and correctly positioned along the central axis of the filter 1. This is an important quality control parameter for the manufacturing process—if the CA thread is off-centre in the filter 1, this might impact the flavour-dispersal properties.

A further benefit of using cellulose acetate rather than cotton for the central thread is that a CA thread is less susceptible than cotton or many other materials to changes in length. For example, cotton is relatively elastic. If cotton yarn is used as a central element in a filter rod, the cotton may be held under tension during the manufacturing process. When the filter rod is cut into segments and the tension therefore released, the cotton may return to its original length, and so retract into the body of the filter rod. In this case, the cotton may no longer be visible at the ends of the filter, and hence cannot be used by a machine vision system to confirm the positioning of the central element. Forming the central thread out of cellulose acetate, which is less elastic than cotton, helps to avoid such problems by reducing any change in length of the central thread during manufacture.

In known filters (with or without a central thread), it is common to use a plasticiser, such as triacetin (1,2,3-triacetoxypropane), to bind the cellulose acetate filaments in the filter material via cross-linkage. This results in a more robust filter material that can be cut more cleanly. Such a plasticiser however has little or no effect on cotton (which is a natural fibre). As a result, there is little if any binding or cross-linkage between a central thread made of cotton yarn and the surrounding cellulose acetate tow of the main filter rod. This leads to the risk that if the central thread is made of cotton, it may become displaced or separated from the filter, for example during the manufacturing process, or as the result of manipulation by the consumer. This in turn will generally degrade delivery of the flavourant (as well as being perceived by consumers as a potential quality defect).

In contrast, any triacetin or other plasticiser applied to the filter can help to bind the CA thread 4 to the cellulose acetate tow of the main filter rod 3. In particular, the triacetin interacts with the filaments of cellulose acetate in the CA thread 4 in substantially the same manner that it interacts with the filaments of cellulose acetate in the tow material of the main filter rod 3. This can then lead to improved binding between the CA thread 4 and the cellulose acetate tow of the main filter rod 3, thereby helping to retain the CA thread 4 at its proper central position within the filter 1.

In one embodiment, triacetin is applied to just the cellulose acetate tow of the main filter rod 3 (as for a conventional filter), and this triacetin is then allowed to migrate into the CA thread 4. However, it is believed that a stronger binding can be obtained by applying the triacetin directly to the CA thread 4 itself (with or without also applying the triacetin to the tow material as well). In one embodiment, triacetin is used as a solvent for the flavourant that is applied to the CA thread 4, from where the triacetin can migrate to the tow material.

In some embodiments, more than one thread (e.g. 2, 3, 4 or 5 threads) may be used to provide the central flavour element. The multiple threads may all be same as one another (e.g. have a common thickness) or may be different from one another. The threads may be wound together to create a larger fibre or yarn, or alternatively the different threads may be kept separate (whether adjacent to one another or separated from one another). Providing multiple threads within the filter may be used to reduce the loading of flavourant per thread (which may assist with manufacturing, product storage, etc). Alternatively, having multiple threads in the filter can be used to increase the total loading of flavourant within the filter. A further possibility is that different threads may be provided with different flavourants or other additives (the different threads may be coloured differently to indicate this fact).

In some embodiments, the different threads may be located in positions so as to provide a configuration within the filter that is symmetric about the central longitudinal axis of the filter. This can help to produce a uniform dispersal or distribution of flavourant within the filter.

Various modifications may be made to the embodiments herein before described without departing from the scope of the invention. For example, different filaments of the same thread may have different colouring or thickness. Accordingly, the scope of the invention is defined by the appended claims.

The invention claimed is:

1. A smoking article filter, comprising:

a substantially cylindrical porous filter rod; and a cellulose acetate thread comprising an ordered arrangement of substantially uncrimped cellulose acetate filaments, the cellulose acetate thread extending along the filter substantially parallel to a central cylindrical axis of the filter rod, wherein the cellulose acetate thread has a total denier in the range of 1500-5000, and wherein the cellulose acetate thread has a higher density than the porous filter rod.

2. The filter according to claim 1, wherein the cellulose acetate thread extends along substantially the whole length of the filter rod.

3. The filter according to claim 1, wherein the porous filter rod comprises cellulose acetate tow.

4. The filter according to claim 3, wherein the cellulose acetate tow comprises a disordered overlapping arrangement of cellulose acetate filaments, such that the cellulose acetate thread is structurally distinct from the cellulose acetate tow.

5. The filter according to claim 1, wherein the cellulose acetate thread includes a flavorant.

6. The filter according to claim 5, the filter further comprising one or more additional cellulose acetate threads, wherein the multiple threads extend substantially parallel to the central cylindrical axis of the filter rod, and different threads include a different flavorant.

7. The filter according to claim 6, wherein the cellulose acetate threads include pigments that impart colors to the threads, the color corresponding to the flavorant included in the thread.

8. The filter according to claim 1, wherein the cellulose acetate filaments of the cellulose acetate thread include a pigment.

9. The filter according to claim 8, wherein the cellulose acetate thread has a different color from the porous filter rod.

10. The filter according to claim 1, wherein the cellulose acetate filaments in the thread have a twist rate in the range of 100-200 turns per meter.

11. The filter according to claim 1, wherein the cellulose acetate thread extends along the central cylindrical axis of the filter rod.

12. The filter according to claim 1, wherein there are multiple cellulose acetate threads extending along the filter parallel to the central cylindrical axis of the filter rod, and said multiple cellulose acetate threads are arranged in a substantially symmetric pattern about the central cylindrical axis of the filter rod.

13. A smoking article filter, comprising:

a substantially cylindrical porous filter rod; and a cellulose acetate thread comprising an ordered arrangement of cellulose acetate filaments that include a pigment, the cellulose acetate thread extending along the filter substantially parallel to a central cylindrical axis of the filter rod and configured to prevent staining and discoloration of the filter rod, wherein the cellulose acetate thread has a total denier in the range of 1500-5000, and wherein the cellulose acetate thread has a higher density than the porous filter rod.

14. The filter according to claim 13, wherein the cellulose acetate thread extends along substantially the whole length of the filter rod.

15. The filter according to claim 13, wherein the porous filter rod comprises cellulose acetate tow.

16. The filter according to claim 15, wherein the cellulose acetate tow comprises a disordered overlapping arrangement of cellulose acetate filaments and the cellulose acetate thread comprises an ordered arrangement of cellulose acetate filaments extending substantially parallel to the central cylindrical axis of the filter rod, such that the cellulose acetate thread is structurally distinct from the cellulose acetate tow.

17. The filter according to claim 13, wherein the cellulose acetate thread incorporates a flavorant.

18. The filter according to claim 17, wherein the filter comprises multiple cellulose acetate threads extending substantially parallel to the central cylindrical axis of the filter rod, and different threads incorporate different flavorants.

19. The filter according to claim 18, wherein the cellulose acetate threads include pigments such that the color of a thread is dependent on the flavorant incorporated into the thread.

20. The filter according to claim 13, wherein the pigment imparts a color to the cellulose acetate thread that is different from the color of the porous filter rod.

* * * * *